United States Patent [19]

Stegmeier

[11] Patent Number: 4,574,017

[45] Date of Patent: Mar. 4, 1986

[54] METHOD FOR SECURING CONCRETE FORM BOARD TO POOL AND MAINTAINING CONCRETE FROM POOL LINER TRACK

[76] Inventor: William J. Stegmeier, 3313 Ambassador Row, Arlington, Tex. 76013

[21] Appl. No.: 663,066

[22] Filed: Oct. 18, 1984

[51] Int. Cl.[4] ..... F04G 17/00; B28B 7/06; E04B 1/16

[52] U.S. Cl. ..... 156/60; 156/247; 156/344; 156/506; 249/83; 249/19; 249/134; 249/DIG. 3; 249/188; 52/169.7; 52/379; 264/35

[58] Field of Search ..... 249/1, 2, 19, 134, 187 R, 249/188, 189, 205, 206, 207, 210, 219 R, DIG. 3; 52/169.7, 169.1, 169.10, 169.11, 169.12, 379, 747; 156/60, 247, 344; 264/35

[56] References Cited

U.S. PATENT DOCUMENTS

| | | | |
|---|---|---|---|
| 3,319,384 | 5/1967 | Berg . | |
| 3,348,801 | 10/1967 | Deason | 249/DIG. 3 |
| 3,512,318 | 5/1970 | Turner . | |
| 3,524,291 | 8/1970 | Rozanski . | |
| 3,526,070 | 9/1970 | Deason | 249/134 X |
| 3,592,435 | 9/1968 | Mattingly | 249/DIG. 3 |
| 3,605,357 | 9/1971 | Stegmeier . | |
| 3,708,930 | 1/1973 | Stegmeier . | |
| 3,753,545 | 8/1973 | Stegmeier . | |
| 3,778,019 | 12/1973 | Stegmeier | 249/DIG. 3 |
| 3,831,897 | 8/1974 | Stegmeier . | |
| 3,850,403 | 11/1974 | Stegmeier . | |
| 3,850,404 | 11/1974 | Stegmeier . | |
| 3,871,147 | 3/1975 | Stegmeier . | |
| 3,871,787 | 3/1975 | Stegmeier . | |
| 3,872,195 | 3/1975 | Stegmeier . | |
| 3,904,717 | 9/1975 | Stegmeier . | |
| 3,967,422 | 7/1976 | Stegmeier | 249/207 X |
| 3,968,191 | 7/1976 | Stegmeier | 52/169.7 X |
| 3,974,620 | 8/1976 | Stegmeier | 249/207 X |
| 3,987,997 | 10/1976 | Stegmeier | 249/207 |
| 4,048,270 | 9/1977 | Stegmeier | 52/169.7 X |
| 4,136,850 | 1/1979 | Grosch | 249/DIG. 3 X |
| 4,318,254 | 3/1982 | Stegmeier . | |
| 4,340,200 | 7/1982 | Stegmeier | 249/219 R X |
| 4,387,877 | 6/1983 | Deason | 249/DIG. 3 |
| 4,395,014 | 7/1983 | Deason | 249/DIG. 3 |

*Primary Examiner*—J. Howard Flint, Jr.
*Attorney, Agent, or Firm*—C. Michael Zimmerman

[57] ABSTRACT

A semi-rigid pool coping form board of the type which is temporarily adhered on the generally vertical surface of a pool mouth-bounding structure to project a uniform height above the generally horizontal upper surface of that bounding structure is provided where its basal feet adjoin its coping inner edge-molding concave surface with an integral bead. At regular intervals, the bead is replaced by a spring clip with a similarly shaped nose. Each spring clip is rooted in the foam board to a standard depth with the aid of a stop shoulder and an adhesive. By locating in, snapping into and filling the liner track channel mouth the bead/spring clip structure automatically locates the form boards heightwise in relation to the pool mouth-bounding structure, provides an easy to use and effective secondary securement system for the form boards and keeps the pool liner track channel so free of cement that any clean-up needed is minor.

10 Claims, 3 Drawing Figures

METHOD FOR SECURING CONCRETE FORM BOARD TO POOL AND MAINTAINING CONCRETE FROM POOL LINER TRACK

BACKGROUND OF THE INVENTION

This invention relates to forming concrete deck coping at the edge of a swimming pool. More particularly, this invention relates to steps in constructing a pool liner using a coping form board.

Swimming pools now being constructed typically have a concrete or other set composition deck formed around the perimetrical edges of their mouths.

The present standard practice to construct the same is to complete a bounding structure around the pool mouth, i.e., one which provides a stable, generally vertical surface adjoining a generally horizontal surface, temporarily mount a set of semi-rigid form boards to the vertical surface so that they project upward above the horizontal surface by the desired thickness of the coping, pour and finish the coping on the horizontal surface behind the form boards, and, after the material of the coping has set to a satisfactory extent, strip the form boards to expose the perimetrically inner edge of the coping.

Most usually, the inner face of the form boards, above the level of the aforesaid generally horizontal surface of the bounding structure, is concavely profiled so as to mold a corresponding convex profile on the perimetrically inner edge of the coping.

It has become conventional to construct the form boards of polystyrene foam extrusions of convenient lengths, e.g., each eight feet long, and to secure the lower, inner generally vertical faces of these to the aforesaid vertical surface of the bounding structure, end to end, using a plurality, e.g., two, vertically spaced longitudinally extending strips of double-sided adhesive tape. Between these strips it has become common to cut or otherwise form a kerf in each form board, so that the tape-bearing basal portions have become called "feet". For convenience, the form boards generally are supplied with the double-sided adhesive tape already located on the feet, but protected by plasticized paper backing strips which are pulled off and discarded immediately prior to mounting of the form boards.

It has been commonly experienced that the double-sided adhesive tape by itself insufficiently mounts the form boards to the bounding structure. All too likely is the possibility that while the cement or the like is still very fluid after a pour, poor adhesion somewhere around the pool mouth, e.g., because there was an oil film on some of the bounding structure, will result in premature separation of the form boards from the bounding structure. Accordingly, it has become usual to provide a secondary securement system. These generally have in common that after the pour has set, they are disconnected off intermediate their lengths or otherwise to disconnect them from the bounding structure so that as the form boards are removed little or nothing remains visible as artifacts of their having been used.

At present, the principal, subsurface water-container basins of swimming pools typically are of two distinct types. According to one type, the pit which has been dug is lined with reinforcing material such as steel mesh and then sprayed with concrete, e.g., using a Gunite process to form a reinforced concrete shell. According to the other principal type, the aforesaid bounding structure of the pool is provided with a perimetrically-extending, inwardly-opening channel or groove. A water-impervious, flexible liner of synthetic plastic sheet material is spread across the floor and up the sidewall of the pit and its outer, upper perimetrical edge, which is integrally formed with an enlarged bead, is stuffed or slid and locked into the aforementioned groove.

The process of the present invention was developed principally for use in constructing swimming pools of the second-mentioned principal type, i.e., so-called liner pools, although it is conceivable the process could be used with or without some modification in the construction of pools of other than this type.

Heretofore in the construction of liner pools using the ways and means which have so far been described, it has been difficult to secure the form boards at a uniform height about the perimeter of the bounding structure, to provide a satisfactory secondary securement system, and, after the form boards have been removed, to ready the channel for receipt of the outer, upper perimetrical bead of the pool liner. As to the latter, it has been difficult or impossible, given the other design constraints, to keep wet concrete from flowing into the channel during formation of the deck, so that cleaning the channel of a substantial amount of at least partially set concrete has been a troublesome but necessary task.

SUMMARY OF THE INVENTION

It is an object of the invention to provide a method of utilizing a specially designed form board which is self-locating heightwise relative to the pool mouth-bounding structure, which provides an easy to use and effective secondary securement system for the form boards and which keeps the groove or channel of the pool liner track so free of cement that any clean-up needed is minor.

Further objects are the provision of ways and means for efficiently using such form boards in the construction of swimming pools, especially of liner pools.

A semi-rigid pool coping form board of the type which is temporarily adhered on the generally vertical surface of a pool mouth-bounding structure to project a uniform height above the generally horizontal upper surface of that bounding structure is provided where its basal feet adjoin its coping inner edge-molding concave surface with an integral bead. At regular intervals, the bead is replaced by a spring clip with a similarly shaped nose. Each spring clip is rooted in the foam board to a standard depth with the aid of a stop shoulder and an adhesive. By locating in, snapping into and filling the liner track channel mouth the bead/spring clip structure automatically locates the form boards heightwise in relation to the pool mouth-bounding structure, provides an easy to use and effective secondary securement system for the form boards and keeps the pool liner track channel so free of cement that any clean-up needed is minor.

The principles of the invention will be further discussed with reference to the drawing wherein a preferred embodiment is shown. The specifics illustrated in the drawing is intended to exemplify, rather than limit, aspects of the invention as defined in the claims.

DETAILED DESCRIPTION

A semi-rigid coping form board embodying principles of the present invention is illustrated in the figures at 10.

Figure 1:
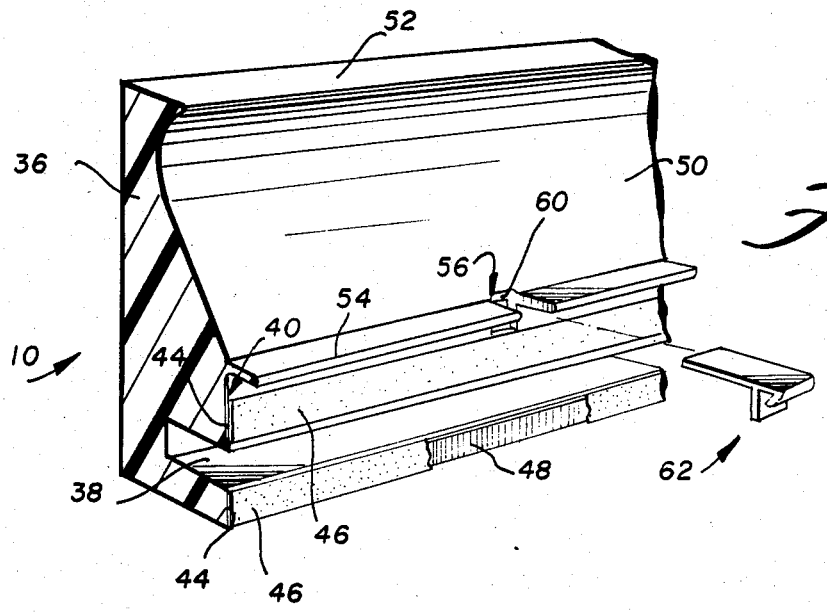
FIG. 1 is a fragmentary perspective view looking toward the outer face of a coping form board embodying principles of the present invention, showing installation of a spring clip in that form board during manufacture thereof.
Figure 2:
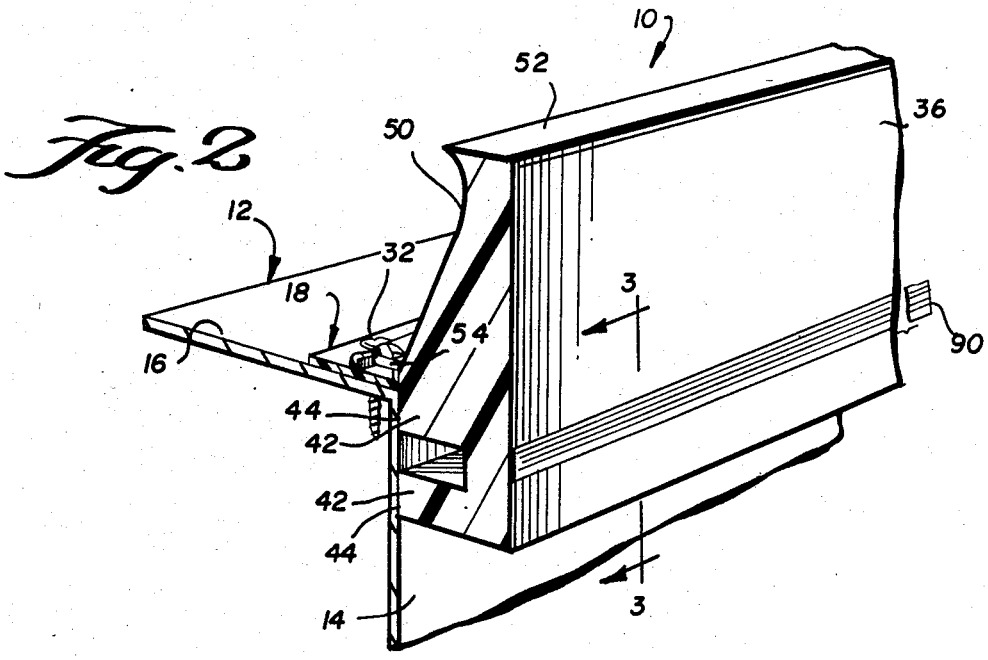
FIG. 2 is a fragmentary perspective view of the form board as mounted to a pool mouth-bounding structure in preparation for the pouring and finishing of a concrete pool coping, the frontal plane of the view representing a vertical transverse section of the structure depicted.
Figure 3:
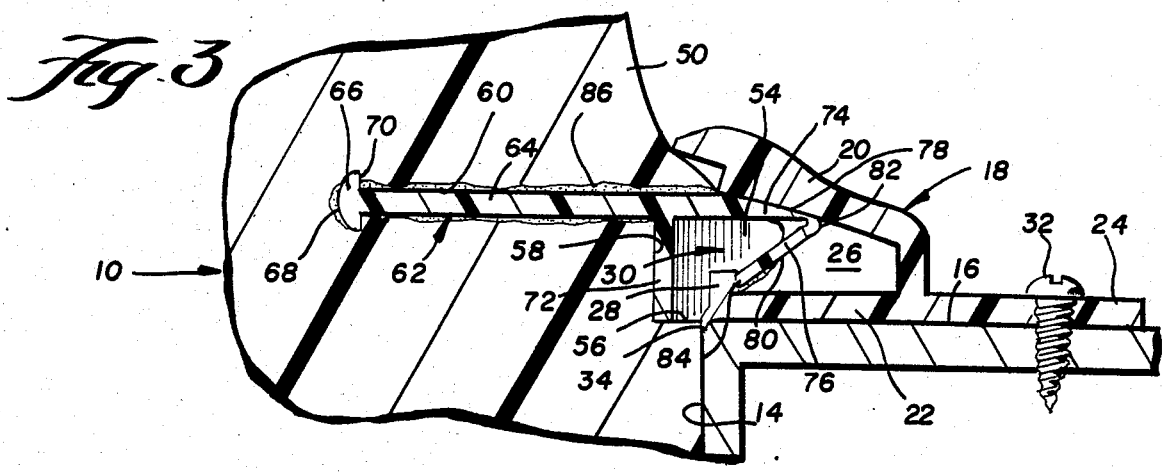
FIG. 3 is a fragmentary transverse sectional view on line 3—3 of FIG. 2, showing the nose of a spring clip as secured in the channel of the pool liner track.

It is convenient for setting the stage for understanding those principles to take a preliminary look at the pool structure that is illustrated in FIG. 2.

In the course of constructing a liner pool, a pit has been dug in the ground; other preliminary constructional steps have been carried out conventionally, culminating in the provision and fixed securement about the perimeter of the pool mouth of a bounding structure 12 of any desired type by any suitable means. In the instance illustrated, the bounding structure is fabricated of aluminum plate, but it could be formed of concrete, concrete/metal/synthetic plastic resin composite or the like. What is important is that it provide a generally vertical inner surface 14 which adjoins at its upper margin the inner margin of a generally horizontal, upwardly-presented surface 16.

A pool liner track 18 is shown mounted to the bounding structure 12 so that it runs substantially completely around the pool mouth adjacent where the surface 14 adjoins the surface 16. In the instance depicted, the pool liner track 18 has the form of an inverted T, with its leg 20 folded to lie adjacent but spaced above one of its arms 22, so as to provide an outwardly projecting, generally horizontal mounting flange 24 and an inwardly opening generally horizontal channel 26. The tip of the arm 22 is angled upwards at 28 to constrict the mouth or opening 30 of the channel 26. The profile depicted is preferred. The pool liner track 18 preferably is extruded of a stiffly flexible, resilient synthetic plastic resin material such as polyvinylchloride. The pool liner track 18 is shown placed flat on the horizontal surface 16 so that the mouth entrance to the channel 26 is flush with the vertical surface 14 and secured in place by installing sheet metal screws 32 vertically downwards through the mounting flange 24 into the bounding structure 12. The screws 32 are located about four inches apart about the whole of the periphery of the pool mouth, spaced about one inch outwardly of the corner 34 where the surfaces 14 and 16 adjoin. The pool liner track 18 and the way that it is installed may be conventional.

The coping form board 10 comprises a main body 36 portion which preferably originates as an extrusion of semi-rigid polystyrene foam of the type used for panels of thermal insulation in the manufacture of refrigerators. The extruded main body, originally of constant transverse cross-sectional size and shape along its length, is sawn into boards of convenient stock length, e.g., each eight feet long, and laterally kerfed at 38 intermediate the height of the generally vertical outer face 40 of the base thereof so as to provide two vertically-spaced, longitudinally extending feet 42, having coplanar soles 44 presented in the same direction. These soles are plated with respective strips of double-sided adhesive tape 46 or other preferably pressure-sensitive adhesive, which is protected until time of use by being covered with plasticized-paper peel-off cover strips 48. One or more longitudinally extending strips of filamented tape may be provided on the body, each with a graspable tab portion at one end for use in stripping the respective lengths of coping form board from the coping after the concrete or other settable composition has sufficiently set.

At a location spaced above the upper one of the feet 42, the outer face of the coping form body 36 is concavely profiled as at 50, so as to be constructed and arranged to mold a corresponding complex inner end lip on the pool coping. The upper end 52 of the body 36, being preferably flat, facilitates leveling the concrete and finishing the coping to that level.

In accordance with principles of the present invention, the body 36 is further provided on its outer face with an outwardly projecting, longitudinally extending lip 54, preferably formed integrally with and of the same material as the body. The lip 54 is not as prominent as the channel 26 is deep, preferably tapers slightly in thickness from its base towards its free outer end, and is at least slightly thicker at its base than the width (vertical direction) of the channel 26 at its mouth or opening 30.

In fabricating the coping form boards 10, at each of a plurality of regularly spaced sites (e.g., six inches apart, on centers) along the length of the body extrusion, an axially short piece of the lip 54 (and preferably a shallow portion of the base of the body) is cut away to a uniform depth using any convenient means such as a router, milling head or the like, so as to provide a lipless site 56. Each of the sites 56 measures, e.g., one-half inch longitudinally of the board, and has an outwardly-presented, generally vertically-oriented stop surface 58 located a uniform distance (e.g., slightly more than 0.09 inch) back of the plane of the feet 42. Within each lipless site, a deep (e.g., one inch deep) socket 60 is formed in the base of the body so as to open outwards. Each socket or slot 60 may be made by piercing, e.g., using a knife blade, or by sawing, e.g., using a sabre saw, or by any convenient means.

The coping form board is completed by mounting a spring clip 62 at each of lipless sites 56.

By preference, each spring clip 62 is a stiffly flexible extrusion of synthetic plastic material, e.g., polyvinylchloride, sawn to a length which corresponds to the length of each lipless site, e.g., one-half inch. In the preferred form which is illustrated, each spring clip 62 has an elongated shank 64 provided with an enlarged, e.g., half-round anchor 66 at its free end, oriented to make the shank easy to insert in a slot 60, but difficult to withdraw, because of the rounded end surface 68 and the inwardly-facing shoulders 70.

Near its outer end, the shank 64 is provided with a transversely projecting flange 72, e.g., one which projects generally vertically downwards to provide a stop flange for facilitating setting the spring clips at a standard depth in the base of the coping form board body.

Outwardly of its stop flange 72, the spring clip shank is shown provided with a spring clip nose in the form of two flanges 74, 76, the outer surfaces 78, 80 of which form a wedge (e.g., having an inclined angle of 51°), and a blunt-pointed outwardly-presented corner 82 (e.g., having an outer radius of 0.075 inch and an inner radius of 0.025 inch), marking the thinnest section of the nose.

The flange 74 is based at one end on the outer end of the shank 64; the flange 76 has its outer end free, as at 84. The thickness of the spring clip nose, e.g., between the surfaces 78, 80 at 84 is greater than the corresponding degree of openness dimension of the mouth 30 of the channel 26 of pool liner track. Yet the combined degrees of flexibility of the spring clip nose and the pool liner track are sufficient to permit the nose to be resiliently snapped into the pool liner track channel 26 through the mouth 30, whereupon the free end 84 of the flange 76 catches against the ledge 28 to prevent non-destructive withdrawal.

The spring clips are mounted to the coping form board by jamming the shank of each into a respective socket 60 until its stop flange 76 abuts the stop surface 58 of the respective lipless site 56, preferably after coating the shank 64 with a suitable adhesive 86. Accordingly, the spring clip noses remain exposed at the lipless sites 56 as general continuations of the profile of the lip 54, although the free ends 84 of the flanges 74 project somewhat below the lip 54.

In assembling a coping form board to a pool mouth-bounding structure 12 which has already been provided with a pool liner track 18 as aforesaid, the cover strip which masks the adhesive 46 on the feet soles 44 first is peeled off. The coping form board is oriented so that its lip 54 and the noses 82 of its spring clips abut the mouth 30 of the channel 26, with the concave profile 50 extending above the surface 16. The inner face 88 of the coping form board is then given an outward tap, e.g., by slapping a hand palm against it several times, once each foot or so along its length, causing the lip and spring clip noses to flex and enter the channel 26, substantially closing its mouth. The snapping of the spring clips 62 into the pool liner track creates a tension tie constituting a secondary securement system holding the copying form board tight against the pool mouth-bounding structure 12 for the concrete pour.

With half-inch polyvinylchloride spring clips set on six-inch centers, each will hold back about twelve pounds of concrete. Where more holding force is needed, the clips may be broadened, e.g., each clip that is five-eighths of an inch broad will hold back sixteen pounds of concrete or each that is three-quarters of an inch broad will hold back twenty pounds of concrete, and so forth.

Like boards 10 are installed end to end in a similar manner about the periphery of the pool mouth. Any boards 10 which must transit small radius curves, e.g., at corners of a pool mouth, may be pre-bent and taped with filamented tape in a now well-known manner.

Once all of the pool mouth is bounded by boards 10, the coping concrete or other settable composition is poured, leveled or otherwise finished, and permitted to sufficiently set so as to be self-sustaining in shape. The boards 10 are then stripped away, leaving a finished coping and a pool liner track 18, the channel 26 of which is substantially free of cement and ready to receive the pool liner bead. As the boards 10 are pulled away progressively, by pulling on an end tab 90 on each, the clips 62 are caused to serially yield, bend or fail. They typically will fail, breaking at 82, where they are their thinnest, as more pull is placed on them than they are designed to withstand, e.g., somewhat more than twelve pounds pull on a one-half inch PVC clip.

It should now be apparent that the method for securing concrete form board to pool and maintaining concrete from pool liner track as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the claims.

What is claimed is:

1. A method for achieving a standard relationship in mounting a coping form board to a pool mouth-bounding structure which has an inwardly-opening, constricted-mouthed pool liner track provided thereon perimetrically of the pool mouth above an at least generally vertically-oriented, inwardly-facing surface of the pool mouth-bounding structure, so as to provide a form for molding the inner end surface of coping for the pool from an originally fluent, settable composition such as concrete, said method comprising:

providing said coping form board to have an outer face having a profile on an upper portion thereof suitable for molding the inner end surface of coping for the pool, to have at least one outwardly-presented, foot sole on a lower portion thereof and, between said upper and lower portions, to have at least one outwardly projecting, longitudinally extending outwardly tapering protrusion which, basally thereof, is at least slightly thicker when free than the corresponding degree of openness dimension of said constricted-mouthed pool liner track;

at least generally aligning said at least one protrusion form board with the mouth of the pool liner track; and pushing the coping form board outwardly towards said pool mouth-bounding structure sufficiently to cause said at least one protrusion to forcibly enter said pool liner track through the mouth thereof and to cause the at least one foot sole to engage said at least generally vertically-oriented, inwardly-facing surface of the pool mouth-bounding structure.

2. The method of claim 1, wherein:

the step of providing said at least one protrusion comprises integrally molding a longitudinally extending lip on said coping form board.

3. The method of claim 2, wherein:

said coping form board comprises a body molded of semi-rigid polystyrene foam material and said lip is integrally molded thereon of said material.

4. The method of claim 1, wherein:

the step of providing said at least one protrusion comprises mounting a plurality of longitudinally spaced spring clips to said coping form board.

5. The method of claim 4, wherein:

each spring clip is mounted to said coping form board by forming a respective site on said coping form board; providing a slot transversely into said coping form board; and inserting a shank portion of such spring clip in such slot to a uniform depth; and anchoring that shank portion in such slot.

6. The method of claim 5, wherein:

said shank portion is anchored in said slot with the aid of adhesive applied to said shank.

7. The method of claim 5, wherein:

said shank portion is inserted to a uniform depth in said slot with the aid of a stop shoulder formed on said shank for abutment with said pool mouth-bounding structure when said shank has achieved said uniform depth.

8. The method of claim 1, wherein:

said at least one protrusion is provided so extensively that upon forcibly entering said pool liner track, said at least one protrusion blocks so much of the mouth of said pool liner track, as settable composition is provided onto said pool mouth-bounding structure outwardly of and against said coping form board, said composition is effectively prevented from entering said pool liner track through said mouth thereof.

9. A method for achieving a standard relationship in mounting a coping form board to a pool mouth-bounding structure which has an inwardly-opening, constricted-mouthed pool liner track provided thereon perimetrically of the pool mouth above an at least generally vertically-oriented, inwardly-facing surface of the pool mouth-bounding structure, so as to provide a form for molding the inner end surface of coping for the pool from an originally fluent, settable composition such as concrete, said method comprising:

providing said coping form board to have an outer face having a profile on an upper portion thereof suitable for molding the inner end surface of coping for the pool, to have at least one outwardly-presented, foot sole on a lower portion thereof and, between said upper and lower portions, to have at least one outwardly projecting, longitudinally extending lip which is regionally discontinuous at a plurality of longitudinally spaced sites, in favor of respective spring clips, said lip and said spring clips behind the outermost extent thereof being at least slightly thicker when free than the corresponding degree of openness dimension of said constricted-mouthed pool liner track;

at least generally aligning the lip of the form board with the mouth of the pool liner track; and pushing the coping form board outwardly towards said pool mouth-bounding structure sufficiently to cause said lip to forcibly enter said pool liner track through the mouth thereof, to cause said spring clips to snap into said pool liner track through the mouth thereof, and to cause the at least one foot sole to engage said at least generally vertically-oriented, inwardly-facing surface of the pool mouth-bounding structure.

10. A method for preventing the originally fluent, settable composition being used to mold the coping of a liner pool from leaking into and filling an inwardly-opening, constricted-mouthed pool liner track provided on a pool mouth-bounding structure above an at least generally vertically-oriented, inwardly-facing surface of such structure in an instance where a coping form board is to be mounted to said at least generally vertical inner surface of the pool mouth-bounding structure and extend above an at least generally horizontal, upwardly-facing surface of the pool mouth-bounding structure, said method comprising:

providing a pool liner track mouth-closing protuberance structure on said coping form board so that as said coping form board is mounted to said pool mouth-bounding structure, said mouth-closing protuberance structure enters and closes the mouth of said pool liner track.

* * * * *